US008267254B2

(12) United States Patent
Cox

(10) Patent No.: US 8,267,254 B2
(45) Date of Patent: Sep. 18, 2012

(54) FLUID SEPARATOR FOR TRASH AND OTHER MATERIALS

(75) Inventor: Donald G. Cox, Bargersville, IN (US)

(73) Assignee: Air Equipment & Engineering, Inc., Martinsville, IN (US)

( * ) Notice: Subject to any disclaimer, the term of this patent is extended or adjusted under 35 U.S.C. 154(b) by 60 days.

(21) Appl. No.: 12/822,563

(22) Filed: Jun. 24, 2010

(65) Prior Publication Data

US 2011/0315606 A1 Dec. 29, 2011

(51) Int. Cl.
*B07B 4/00* (2006.01)
*B07B 7/00* (2006.01)

(52) U.S. Cl. ..... 209/141; 209/139.1; 209/140; 209/147; 209/149

(58) Field of Classification Search ..... 209/136, 209/137, 138, 139.1, 140, 141, 147, 149, 209/930, 643
See application file for complete search history.

(56) References Cited

U.S. PATENT DOCUMENTS

| | | | | | |
|---|---|---|---|---|---|
| 3,608,716 | A * | 9/1971 | Rowell et al. | ..... | 209/139.1 |
| 3,655,043 | A * | 4/1972 | Wochnowski et al. | ..... | 209/138 |
| 3,833,117 | A * | 9/1974 | Mackenzie et al. | ..... | 209/3 |
| 4,701,256 | A * | 10/1987 | Cross, Jr. | ..... | 209/139.1 |
| 4,721,561 | A * | 1/1988 | Oetiker et al. | ..... | 209/139.1 |
| 4,830,188 | A | 5/1989 | Hannigan et al. | | |
| 4,974,781 | A | 12/1990 | Placzek | | |
| 5,328,034 | A * | 7/1994 | Davis | ..... | 209/31 |
| 5,358,121 | A * | 10/1994 | Robak et al. | ..... | 209/137 |
| 5,725,102 | A * | 3/1998 | Gustavsson | ..... | 209/143 |
| 7,051,880 | B1 * | 5/2006 | Bills | ..... | 209/147 |
| 7,347,333 | B2 * | 3/2008 | Josephs | ..... | 209/720 |
| 8,016,117 | B2 * | 9/2011 | Althouse | ..... | 209/154 |

* cited by examiner

*Primary Examiner* — Joseph C Rodriguez
(74) *Attorney, Agent, or Firm* — Woodard Emhardt Moriarty McNett & Henry LLP

(57) ABSTRACT

A separator for separating trash into its constituents. An inlet conduit accelerates the trash mixture into an expansion chamber allowing the lighter weight materials to move apart from heavier materials. An air fan applies air pressure to the lighter weight materials drawing off the lighter weight materials while the heavier materials fall towards a collecting conveyor by the force of gravity.

11 Claims, 2 Drawing Sheets

FLUID SEPARATOR FOR TRASH AND OTHER MATERIALS

BACKGROUND OF THE INVENTION

1. Field of the Invention

The present invention relates generally to the field of forced fluid separators for use in separating various items of trash and other materials.

2. Description of the Prior Art

Recycling of trash allows for the recovery of resalable materials and avoids land cost. Many techniques are used to attempt the economic separation of trash into its constituents including items of paper, plastic, glass and metal. One approach is for the consumer to manually place each item in a separate trash bin. For example, one bin receives papers products whereas another bin receives glass products. The bins are then collected while maintaining segregation of the items and processed into usable material. Another approach is disclosed in U.S. Pat. No. 4,830,188 wherein beverage bottles are segregated according to specific gravity by floatation. A further approach is disclosed in U.S. Pat. No. 4,974,781 wherein a rotating vessel receives the trash en masse wherein moisture and heat is applied to the material effecting repulping of paper materials.

Many of the existing techniques are not only ineffective but add to the cost of the recycling effort. Disclosed herein is a forced fluid separator that uses the force of the pressurized fluid along with gravity to separate lighter weight materials.

SUMMARY OF THE INVENTION

One embodiment of the present invention is a separator for separating light weight items from heavier items by air pressure and the force of gravity The separator has a first expansion chamber to receive the light weight items mixed with heavier items allowing the light weight items and the heavier items to move apart. A source of air pressure is in fluid communication with the first expansion chamber. A first outlet conduit in fluid communication with the first expansion chamber receives the light weight items from the expansion chamber as the source of air pressure forces the light weight items to move from the first expansion chamber into the first outlet conduit. A second conduit extends beneath the chamber to receive heavier items falling from the chamber under the force of gravity.

It is an object of the present invention to provide a separator for separating light weight materials, such as, paper from heavier products such as plastic, glass and metal.

Another object of the present invention is to provide a separator that utilizes a forced fluid along with gravity to accomplish separation of material into various constituents.

Related objects and advantageous of the present invention will be apparent from the following description.

DESCRIPTION OF THE PREFERRED EMBODIMENT

Figure 1:
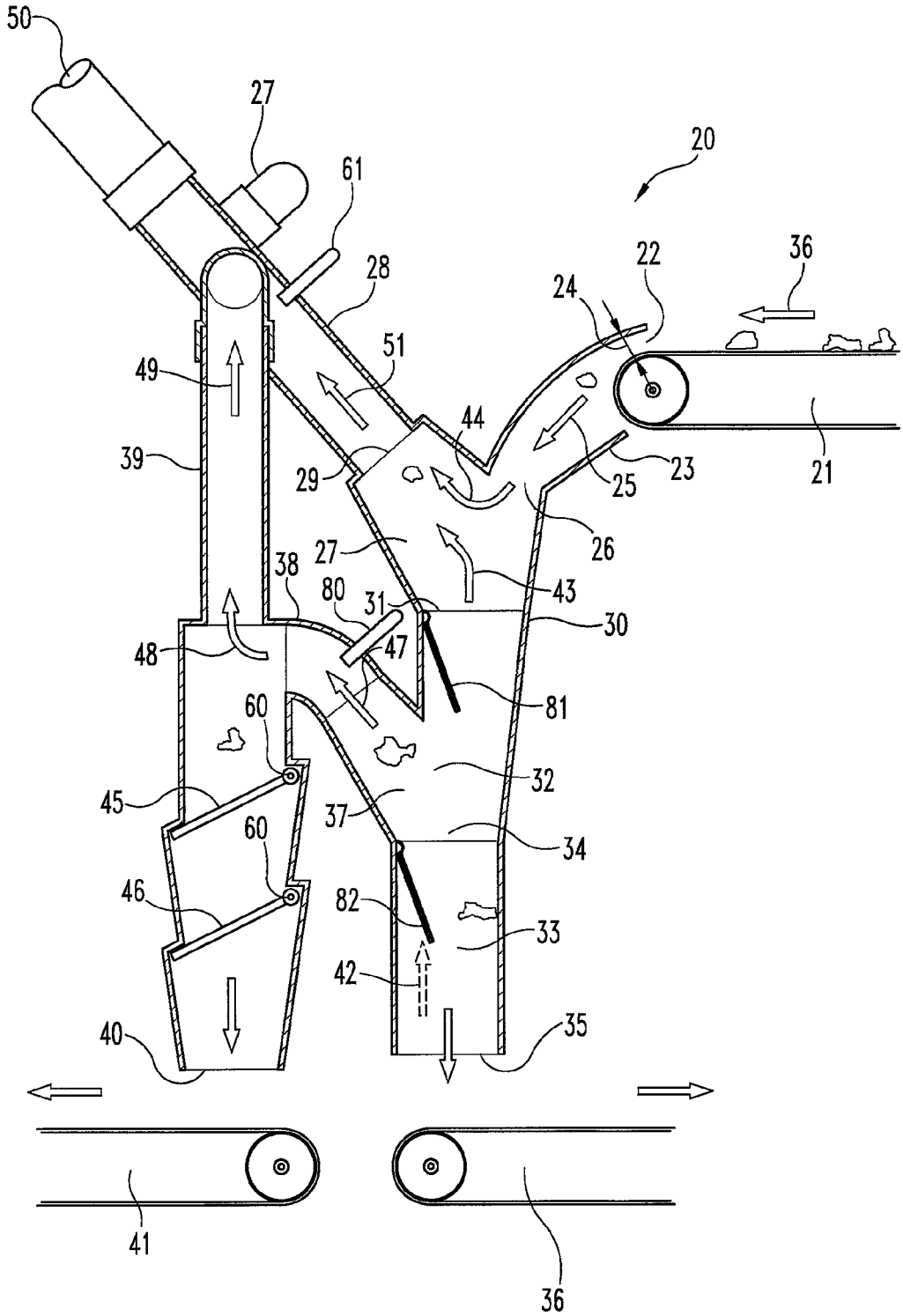
FIG. 1 is a schematic representation of a separator which is the preferred embodiment of the present invention and having two expansion chambers.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a separator 20 for separating lightweight products or items from heavier weight products or items. Separator 20 is particular useful in separating trash into its constituents, namely, paper, plastic, glass and metal. Separator 20 utilizes forced fluid or air pressure along with the force of gravity to accomplish separation. The pressurized fluid is forced against the mixture of trash constituents thereby forcing the lighter weight or less dense or items having larger surface areas into a side conduit while the remaining portion of the trash falls downwardly under the force of gravity.

Shown in FIG. 1 is a fragmentary view of a conventional conveyor 21 that is operable to move the trash in the direction of arrow 36 dumping the trash into the inlet 22 of an input conduit 23. A gap 24 is formed between the interior surface of conduit and the exit end of the conveyor allowing the trash and air to move into the conduit in the direction of arrow 25.

Conduit 23 has an outlet 26 that leads into an expansion chamber 27 that defines a large interior volume. More space is available for the products within the mixture to move apart. As compared to the space within conduit 23, outlet 26 is restricted in area to accelerate the mixture of light weight products and heavier products from conduit 23 and into expansion chamber 27. A restricted throat at outlet 26 creates a higher static loss and thus creates a greater updraft velocity in the direction of arrow 42 then the conveyor end draft velocity shown by arrow 25. This tends to slow the material and create better separation.

A conventional air fan 27 is mounted to conduit 28 having a bottom inlet 29 in fluid communication with chamber 27. Fan 27 is operable to move the air within chamber 27 in the direction of arrow 51 carrying the lightweight products, such as, paper from chamber 27 into conduit 28 while allowing the heavier products such as plastic, glass and metal to fall downwardly from the chamber.

Intermediate conduit 30 is connected to and is in fluid communication with the outlet 31 of expansion chamber 27 and extends downwardly therebeneath opening into a second expansion chamber 32 in fluid communication via intermediate conduit 30 with fan 27. Expansion chamber 32 likewise includes a large internal volume. A further conduit 33 extends downwardly from the outlet 34 of expansion chamber 32 and has a bottom outlet 35 emptying onto a conventional conveyor 36. The top outlet 37 of expansion chamber 32 opens into a connecting conduit 38, in turn, emptying into a downwardly extending conduit 39 eventually emptying via outlet 40 onto a conventional second outlet conveyor 41.

Separator 20 including the various conduits and expansion chambers can be produced from any type of material including sheet metal or plastic. Likewise, the particular configuration, such as having less than or more than two expansion chambers and having more than a single air fan are contemplated and included herein. Likewise, the separator can include a number of outlets greater than or less than a number of outlets shown in the embodiment of FIG. 1.

In the embodiment of FIG. 1, air fan 27 is operable to draw external air through gap 24 along with the mixture of light weight and heavier products. Further, since outlet 35 of conduit 33 is open, the fan is operable to draw external air upwardly in the direction of arrow 42. The external air moving in the direction of arrow 25 as it enters the first expansion chamber 27, is caused to move in the direction of arrow 44 eventually entering conduit 28. Likewise, the external air moving upwardly in the direction of arrow 42 eventually enters the first expansion chamber 27 in the direction of arrow 43 and eventually out through conduit 28 in the direction of arrow 51. The air flow entering expansion chamber 27 causes the light weight products, such as paper to move around expansion chamber 27 since the weight of each light weight product and the surface area of each light weight product is sufficiently great as compared to the heavier products that fall downwardly under the force of gravity through the conduits towards outlet 35.

If any of the light weight products have moved downwardly past expansion chamber 27 and entered intermediate conduit 30, then the air flow moving in the direction of arrow 42 is sufficient to carry the light weight products in a reverse direction upwardly back into the expansion chamber 27 and out of the separator via conduit 28. On the other hand, the air flow moving in the direction of arrow 42 is insufficient to prevent the continued downward movement of the heavier product such as plastic, glass or metal.

Outlet 40 is normally sealed by double tipping valves 45 and 46. Valves 45 and 46 are each hingedly mounted about ends 60 with the opposite ends movable in a counterclockwise direction under the weight of material impacting the valve from atop each valve with the valves then being spring biased to pivot in the clockwise direction sealing off the conduit and preventing air from flowing upwardly through outlet 40. Double tipping valves are commercially available and are well known. The double tipping valves are operable to normally close conduit 39 at the bottom end of the conduit so that external air cannot flow upwardly through outlet 40. As the product falls atop the valve, the weight of the products will cause the valves to pivot downwardly thereby allowing the products above the valves to flow downwardly and out through outlet 40 atop conveyor 41. The top end of conduit 39 is connected to conduit 28 with fan 27 operable to draw air upwardly in the direction of arrow 47 from second expansion chamber 32 into conduit 38 with the upwardly flowing air then flowing in the direction of arrow 48 into conduit 39 and upwardly in the direction of arrow 49 eventually flowing into conduit 28 and exiting the conduit via outlet 50.

Many variations and contemplated and included in the present invention. For example, the embodiment shown in FIG. 1 can be provided with one or multiple expansion chambers depending upon the type of mixture moving from conveyor 22 into conduit 23. For example, expansion chamber 27 may be used to pick off the extremely light weight products in the mixture, such as paper, and route the light weight products up through conduit 28 whereas the heavier products composed of heavier products having a first weight and heavier products having a weight greater than the first weight continue to fall down through intermediate conduit 30 to the second expansion chamber 32 whereat the heavier products of the lesser weight are drawn off upwardly through conduit 38 and then fall downwardly through conduit 39 to conveyor 41 while the heaviest products fall downwardly through the outlet conduit 33 exiting outlet 35 onto conveyor 36. In one embodiment, paper was drawn off expansion chamber 27 moving upwardly through conduit 28 whereas plastic material was drawn off in expansion chamber 32 via conduit 38 and then falling downwardly atop conveyor 41. The heaviest product in the mixture being glass continued to fall downwardly through conduit 33 and exit outlet 35 falling onto conveyor 36. Expansion chambers 27 and 32 thereby provide a double stage separation unit with expansion chamber 27 providing the primary separation stage to separate paper from the plastic and glass with the paper being forced upwardly through conduit 28 and the plastic and glass being discharged from the primary stage formed by expansion chamber 27 and falling into the second separation stage or expansion chamber 32 wherein the plastic is separated from the glass. The paper drawn upwardly through conduit 28 is conveyed through outlet 50 to an air paper separator not shown where the paper will be bailed whereas the plastic and glass are conveyed away from the separator to be separately held.

Air fan 27 is selected to cause sufficient velocity within the separator to cause the light weight items, such as paper to move around within expansion chamber 27 relative to the heavier products and to allow the heavier products in expansion chamber 32 to separate into less heavy items and more heavy items with the less heavy items being forced to move around in expansion chamber 32 and then exit the chamber via conduit 38. Further, the fan is selected to cause any paper products moving downwardly past expansion chamber 27 to then move upwardly back into the expansion chamber and out through conduit 28. Alternative fluids other than air may be utilized depending upon each particular application.

In the event air fan 27 has a constant speed, then a cut off slide gate may be utilized to regulate the air flow through the separator. A commercially available slide gate 61 controllably extends across the interior of conduit 28. With gate 61 in the fully retracted position, the interior of conduit 28 is not impeded whereas with the gate extending entirely across the interior of the conduit, air flow is prevented.

Figure 2:
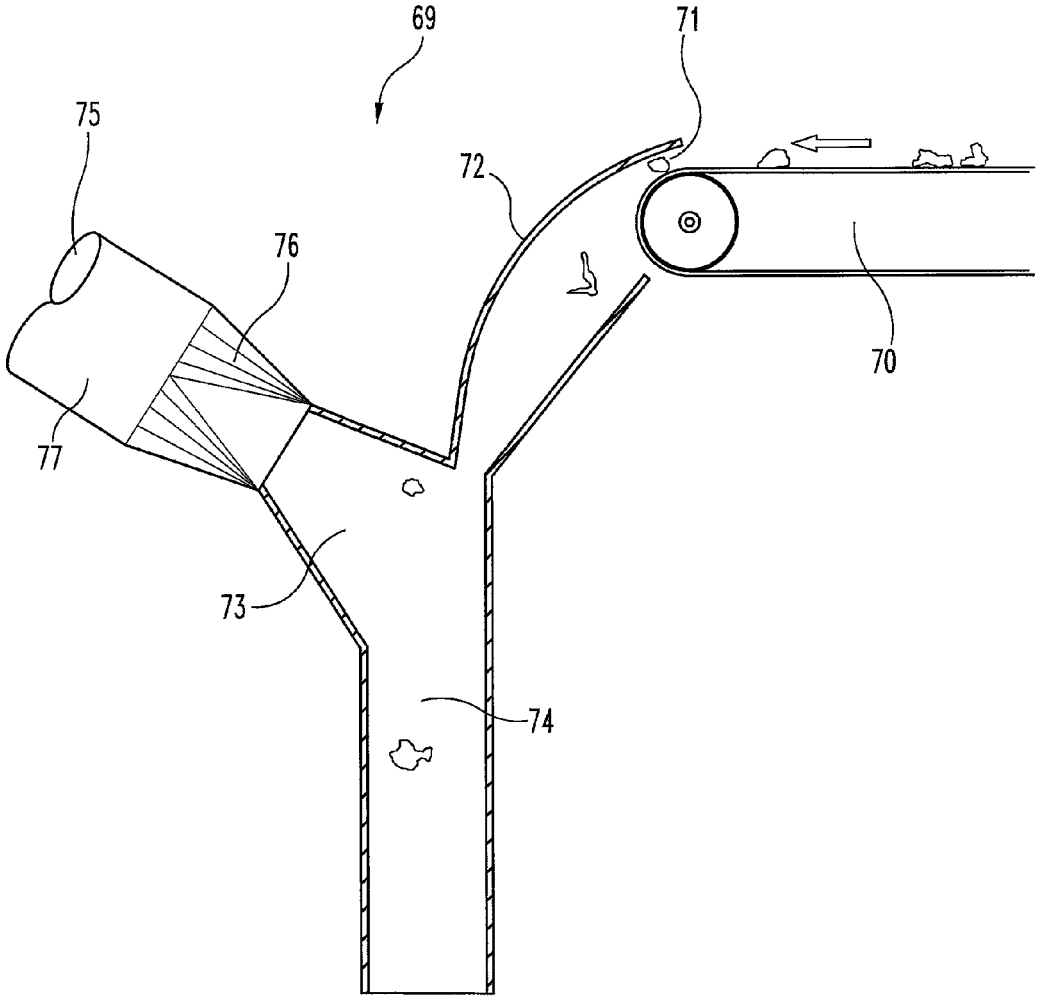
FIG. 2 is a schematic representation of a separator having a single expansion chamber.

In the embodiment shown in FIG. 2, separator 69 is sized for a maximum potential air flow of 4000 feet per minute in the four inch inside diameter exhaust conduit 77. The following chart is a record of data obtained for separator 69 having an input conveyor 70 leading to the input 71 of the inlet conduit 72, in turn, leading to a single stage expansion chamber 73, a bottom outlet 74 and a top outlet 75 with an air fan/slide gate combination 76. The draft velocity at outlet 75 varies from 1070 feet per minute, 1700 feet per minute, 1920 feet per minute, 2250 feet per minute, 3200 feet per minute and a maximum of 4000 feet per minute. The draft air velocity is the sum of the air velocity existing at inlet 71 and the upward air velocity at bottom outlet 74. The air moving downwardly through conduit 72 mixes with the air moving upwardly through the bottom conduit in expansion chamber 73 and then exiting outlet 75 of conduit 77. The data shows the upward air velocity at outlet 74 ranging from 500 feet per minute to a maximum of 2000 feet per minute whereas the downward air velocity entering inlet 71 of conduit 72 ranges from a low of 700 feet per minute to 2500 feet per minute. It may be seen in each case that the sum of the velocities of inlet 71 and outlet 74 approximates the draft velocity at outlet 75. The cubic feet per minute of the volume of air corresponding to the various velocities were also recorded at the inlet 71, outlet 74 and outlet 75.

| | V | CFM | V | CFM | V | CFM | V | CFM | V | CFM | V | CFM |
|---|---|---|---|---|---|---|---|---|---|---|---|---|
| Inlet 71 | 700 | 729 | 1000 | 1042 | 1250 | 1302 | 1500 | 1563 | 2000 | 2083 | 2500 | 2604 |

-continued

| | V | CFM | V | CFM | V | CFM | V | CFM | V | CFM | V | CFM |
|---|---|---|---|---|---|---|---|---|---|---|---|---|
| Outlet 74 | 500 | 217 | 857 | 380 | 1000 | 434 | 1200 | 521 | 1500 | 6801 | 2000 | 868 |
| Outlet 75 | 1070 | 934 | 1700 | 1484 | 1920 | 1676 | 2250 | 1963 | 3200 | 2793 | 4000 | 3491 |

V = air velocity (feet/minute)
CFM = air cubic feet/minute

Once the material of the mixture of light weight and heavy weight items are fed into the separator, the air velocity at outlet 75 is adjusted via fan gate 76 until the maximum amount of lightweight products are drawn upwardly out of outlet 75. To this extent, it is helpful to produce the conduit from transparent plastic or provide windows within the metal conduits in order to visually identify the quantity of material being withdrawn through the side conduit. Alternatively, the material exiting the bottom conduit via outlet 74 may be examined to ensure that all of the light weight material has been withdrawn.

A marginal separation velocity for paper from a particular sample selected was determined in one example to be about 700 feet per minute. Plastic samples from the trash mix of approximately ¼ inch by ½ inch by ½ inch and chip pieces sized at 1/16 inch by ½ inch by ½ inch separated from a paper plastic mix at an optimum velocity of about 1250 per minute. Glass continued through the expansion chamber at a velocity of 2500 per minute or less. When a mix of glass and plastic were run through the separator, a separation velocity in the expansion chamber was achieved at an exit velocity at outlet 75 of approximately 2000 feet per minute with no plastic moving downward and no glass be drawn through outlet 75.

It has been determined that most glass has a weight of approximately 160 to 180 pounds per cubic foot whereas plastics have a weight from 70 to 85 pounds per cubic foot. Nevertheless, the glass sections tend to be thick when compared to plastic and paper. The plastic pieces are not only heavier than paper but are relatively flat and not distorted like paper scrap. In the event the paper scrap is not of planar configuration but is distorted, for example, such as found when crunched into a ball shape, then the paper is less likely to be drawn off through outlet 75 at low velocities.

Many variations are contemplated and included in the present invention. For example, additional dampers or gates may be utilized to provide more accurate adjustment of air flow. If a single exhaust fan is utilized, then damper 80 may be mounted in conduit 38 in addition to damper 61 provided in conduit 28. Further, if a constant performance fan is utilized, then dampers (swing gates) 81 and 82 may be mounted respectively in conduits 30 and 33. Dampers or gates 61, 80, 81 and 82 are commercially available and swing or move across the interior of the conduit to restrict air flow.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A separator for separating light weight products, such as, paper from heavier products by air pressure and the force of gravity, said heavier products have some of a first weight and some of a greater weight, comprising:

an input conduit to receive light weight products mixed with heavier products and having an opening to external air;

a first expansion chamber in fluid communication with said input conduit to receive from said input conduit external air and said light weight products mixed with said heavier products allowing said light weight products and said heavier products to move apart;

a source of air pressure in fluid communication with said first expansion chamber and drawing external air through said input conduit;

a first outlet conduit in fluid communication with said first expansion chamber to receive said light weight products from said expansion chamber as said source of air pressure forces said light weight products to move from said first expansion chamber into said first outlet;

a second conduit extending beneath said chamber to receive heavier products falling from said chamber under the force of gravity, said second conduit having a second outlet through which said heavier products exit said separator under the force of gravity, said second outlet allowing external air to be pulled by said source of air pressure upwardly carrying along any of said light weight products in said second conduit that have moved past said expansion chamber and to move upwardly back into said expansion chamber while allowing said heavier products to continue falling downwardly;

an intermediate conduit leading downwardly from said first expansion chamber to receive said heavier products falling therefrom;

a third conduit; and, a second expansion chamber in fluid communication with said intermediate conduit, said third conduit and said source of air pressure to receive from said intermediate conduit said heavier products allowing some of said heavier products having a first weight to move apart from some of said heavier products having a greater weight as said source of air pressure forces some of said heavier products of said first weight to move into said third conduit while some of said heavier products of a weight greater than said first weight to fall into said second conduit.

2. The separator of claim 1 and further comprising:

an input conveyor to move said light weight products mixed with heavier products into said input conduit.

3. The separator of claim 2 and further comprising:

a first output conveyor positioned to receive said heavier products from said second conduit.

4. The separator of claim 1 wherein said light weight products are paper and said heavier products of said first weight are plastic and said heavier products of said greater weight are plastic, glass and/or metal.

5. The separator of claim 1 wherein said third conduit includes a portion extending downwardly allowing said heavier products of said first weight to fall downwardly to exit therefrom, said third conduit includes a valve to limit external air to flow into said third conduit but movable to allow said heavier products of said first weight to open said valve.

6. The separator of claim 1 wherein said input conduit includes a restricted outlet connected to said first expansion chamber to accelerate said light weight products mixed with heavier products into said first expansion chamber.

7. A separator for separating light weight items from heavier items by air pressure and the force of gravity comprising:

a first expansion chamber to receive external air and light weight items mixed with heavier items allowing said light weight items and said heavier items to move apart;

a source of air pressure in fluid communication with said first expansion chamber and drawing external air through said first expansion chamber to force said light weight items to separate from said heavier items;

a first outlet conduit in fluid communication with said first expansion chamber to receive said light weight items from said expansion chamber as said source of air pressure forces said light weight items to move from said first expansion chamber into said first outlet conduit; and, a second conduit extending beneath said chamber to receive heavier items falling from said first chamber under the force of gravity, said second conduit having a second outlet through which said heavier items exit said separator under the force of gravity; and wherein:

said second conduit has a vent allowing air to be pulled by said source of air pressure upwardly carrying along any of said light weight items in said second conduit that have moved past said expansion chamber and to move upwardly back into said expansion chamber while allowing said heavier items to continue falling downwardly; and further comprising:

a third conduit;

a second expansion chamber located beneath said first expansion chamber and in fluid communication with said first expansion chamber to receive said heavier items therefrom, said second expansion chamber also in fluid communication with said third conduit and said source of air pressure to force into said third conduit some of said heavier items of a less weight than the other of said heavier items which continue to fall downwardly.

8. The separator of claim 7 and further comprising:

an inlet conveyor having said light weight items mixed with heavier items toward said first expansion chamber;

a first outlet conveyor positioned to receive said heavier items forced into said third conduit; and, a second outlet conveyor positioned to receive said heavier items from said second conduit.

9. A trash separating device to separate paper products from heavier products comprising:

an enclosure having an inlet to receive external air, paper items and heavier items, said enclosure having a first expansion chamber into which external air flows to allow said paper items to move apart from said heavier items;

a paper items outlet;

a downwardly extending outlet through which said heavier items fall substantially vertically out of said device;

a source of fluid pressure connected to and in fluid communication with said enclosure that draws external air into said first expansion chamber through said inlet to force said paper items to move around in said first expansion chamber and apart from said heavier items and to force said paper items into said paper items outlet while said heavier items fall under the force of gravity from said first expansion chamber into and through said downwardly extending outlet and out of said device; and, an additional outlet; and wherein:

said enclosure has a second expansion chamber connected to said additional outlet with said second expansion chamber located beneath said first expansion chamber to receive said heavier items from said first expansion chamber and allowing said heavier items to separate apart into less heavy items and more heavy items, said enclosure is in fluid communication with said source of fluid pressure which forces said less heavy items out of said second expansion chamber into said additional outlet while said more heavy items fall downwardly under the force of gravity out of said second expansion chamber into said downwardly extending outlet.

10. The trash separating device of claim 9 wherein said paper items outlet extends upwardly from said first expansion chamber.

11. The trash separating device of claim 9 wherein said source of fluid pressure is an air fan drawing air into said inlet of said enclosure and also into said downwardly extending outlet and then through said first expansion chamber and into said paper items outlet.

* * * * *